US006497809B1

(12) United States Patent
Brown et al.

(10) Patent No.: US 6,497,809 B1
(45) Date of Patent: Dec. 24, 2002

(54) METHOD FOR PROLONGING THE EFFECTIVENESS OF A PYROLYTIC CRACKING TUBE TREATED FOR THE INHIBITION OF COKE FORMATION DURING CRACKING

(75) Inventors: Ronald E. Brown; Timothy P. Harper; Larry E. Reed, all of Bartlesville, OK (US)

(73) Assignee: Phillips Petroleum Company, Bartlesville, OK (US)

( * ) Notice: Subject to any disclaimer, the term of this patent is extended or adjusted under 35 U.S.C. 154(b) by 1000 days.

(21) Appl. No.: 08/548,241

(22) Filed: Oct. 25, 1995

(51) Int. Cl.[7] ..... C10G 9/16; C10G 75/04

(52) U.S. Cl. ..... 208/48 R; 585/648; 585/649; 585/650

(58) Field of Search ..... 208/48 R, 132; 585/648, 649, 650

(56) References Cited

U.S. PATENT DOCUMENTS

| | | | | |
|---|---|---|---|---|
| 4,097,362 A | | 6/1978 | McKinney et al. | 208/78 |
| 4,119,528 A | | 10/1978 | Baird, Jr. et al. | 208/108 |
| 4,179,355 A | | 12/1979 | Frayer et al. | 208/89 |
| 4,370,221 A | | 1/1983 | Patmore et al. | 208/112 |
| 4,692,234 A | | 9/1987 | Porter et al. | 208/48 |
| 5,405,525 A | * | 4/1995 | Heyse et al. | 208/133 |
| 5,413,700 A | * | 5/1995 | Heyse et al. | 208/134 |

FOREIGN PATENT DOCUMENTS

| | | | |
|---|---|---|---|
| EP | 0 241 020 | 10/1987 | C07C/4/04 |
| FR | 1497055 | 12/1967 | |
| GB | 1153531 | 5/1969 | C07C/3/30 |

* cited by examiner

*Primary Examiner*—Bekir L. Yildirim
(74) *Attorney, Agent, or Firm*—Charles W. Stewart

(57) ABSTRACT

Process for prolonging the effectiveness of a pyrolytic cracking tube which has been treated with an antifoulant for inhibiting the formation of coke during the cracking of hydrocarbons. The benefits of such treatment are enhanced by the desulfurization of a sulfur-containing feedstock prior to charging it to the treated pyrolytic cracking tube.

8 Claims, No Drawings

METHOD FOR PROLONGING THE EFFECTIVENESS OF A PYROLYTIC CRACKING TUBE TREATED FOR THE INHIBITION OF COKE FORMATION DURING CRACKING

The present invention generally relates to processes for the thermal cracking of hydrocarbons and, specifically, to a method for prolonging the effectiveness of a treated pyrolytic cracking tube in inhibiting the formation of coke during pyrolytic cracking of hydrocarbons.

In a process for producing olefin compounds, a fluid stream containing a saturated hydrocarbon such as ethane, propane, butane, pentane, naphtha, or mixtures of two or more thereof is fed into a thermal (or pyrolytic) cracking furnace. A diluent fluid such as steam is usually combined with the hydrocarbon feed material being introduced into the cracking furnace.

Within the cracking furnace, the saturated hydrocarbons are converted into olefinic compounds. For example, an ethane stream is introduced into the cracking furnace wherein it is converted into ethylene and appreciable amounts of other hydrocarbons. A propane stream is introduced into the cracking furnace wherein it is converted to ethylene and propylene, and appreciable amounts of other hydrocarbons. Similarly, a mixture of saturated hydrocarbons containing ethane, propane, butane, pentane and naphtha is converted to a mixture of olefinic compounds containing ethylene, propylene, butenes, pentenes, and naphthalene. Olefinic compounds are an important class of industrial chemicals. For example, ethylene is a monomer or comonomer for making polyethylene. Other uses of olefinic compounds are well known to those skilled in the art.

A semi-pure carbon which is termed "coke" is formed in the cracking furnace as a result of the furnace cracking operation. Coke is also formed in the heat exchangers used to cool the gaseous mixture flowing as an effluent from the cracking furnace. Coke formation generally results from a combination of a homogeneous thermal reaction in the gas phase (thermal coking) and a heterogeneous catalytic reaction between the hydrocarbon in the gas phase and the metals in the walls of the cracking tubes or heat exchangers (catalytic coking).

Coke generally forms on the metal surfaces of the cracking tubes which are contacted with the feed stream and on the metal surfaces of the heat exchangers which are contacted with the gaseous effluent from the cracking furnace. However, it should be recognized that coke may also form on connecting conduits and other metal surfaces which are exposed to hydrocarbons at high temperatures. Thus, the term "Metals" will be used hereinafter to refer to all metal surfaces of the equipment in a cracking process system which are exposed to hydrocarbons and which are subject to coke deposition.

A normal operating procedure for a cracking furnace is to periodically shut down the furnace in order to burn out the deposits of coke. This downtime results in a substantial loss of production. In addition, coke is an excellent thermal insulator. Thus, as coke is deposited, higher furnace temperatures are required to maintain the gas temperature in the cracking zone at a desired level. Such higher temperatures increase fuel consumption and will eventually result in shorter tube life.

There are certain methods known by those skilled in the art for inhibiting or reducing the formation of coke on Metals. For instance, in U.S. Pat. No. 4,692,234 a method for reducing the formation of coke on the metal surfaces of a cracking process system is described whereby such metal surfaces are treated with an Antifoulant containing tin and silicon.

One phenomenon associated with the utilization of a tin and silicon antifoulant has been the loss of effectiveness of a treatment of the metal surfaces of cracking tubes during their use. While the treatment of cracking tubes with an antifoulant is observed to beneficially reduce the coking rate when the tubes are used to thermally crack hydrocarbons, it has also been observed that the treatment loses its effectiveness during such use. It was not until the discovery of the cause of this rapid loss in treatment effectiveness that a solution was obtainable.

It is, thus, an object of this invention to provide a method for prolonging the effectiveness of treated cracking tubes in resisting the formation of coke during the cracking of hydrocarbons.

The present invention is a method for cracking hydrocarbons using a cracking tube treated for the resistance of coke formation. A cracking tube, which has been treated with a tin and silicon antifoulant material to thereby deposit upon the surfaces thereof tin and silicon, is operated under cracking conditions while passing a desulfurized hydrocarbon feed through such treated tube. The use of a desulfurized or low sulfur feed in the treated tube reduces the rate in the loss of the effectiveness of the antifoulant treatment.

Another embodiment of this invention includes a method for prolonging the effectiveness in resisting coke formation of a pyrolytic cracking tube, treated for the resistance of coke formation, when the treated pyrolytic cracking tube is utilized in cracking hydrocarbons. The method includes desulfurizing a hydrocarbon feed containing a concentration of sulfur to remove at least a portion of the concentration of sulfur to provide a desulfurized hydrocarbon feed. The desulfurized hydrocarbon feed is then passed through the treated pyrolytic cracking tube, having deposited on the surface thereof tin and silicon, operated under suitable cracking conditions.

Other objects and advantages of the invention will be apparent from the detailed description of the invention and the claims.

It is been discovered that the presence of sulfur compounds in a pyrolytic cracking unit feed has a negative impact upon the effectiveness of a treated pyrolytic cracking tube to resist coke formation during its use. Specifically, it has been found that the sulfur in the pyrolytic cracking unit feed interacts with the tin, deposited by a treatment method on the surface of the pyrolytic cracking tubes, so as to strip the tin from the surface of the treated pyrolytic cracking tubes. The stripping of the tin from the treated pyrolytic cracking tube surface results in reducing the effectiveness of the treated pyrolytic cracking tube in resisting the formation of coke during cracking operation. The discovery of this previously unknown mechanism allows the inventors hereof to develop a solution to the problem of sulfur stripping of the tin deposited on the pyrolytic cracking tube surface by an antifoulant treatment method.

The treated pyrolytic cracking tube of the inventive method is a standard pyrolytic cracking furnace tube treated with an antifoulant material, or antifoulant, selected from a group consisting of tin, silicon and mixtures of tin and silicon. Any form of silicon and tin can be utilized as antifoulant material. Elemental silicon, inorganic silicon compounds and organic silicon compounds as well as mixtures of two or more thereof arc suitable sources of silicon. The term "silicon" as used herein refers to any one of these silicon sources, but the preferred silicon source is organic silicon (organosilicon) compounds. Elemental tin, inorganic tin compounds and organic tin compounds as well as mixtures of two or more thereof are suitable sources of tin. The term "tin" as used herein refers to any one of these tin sources, but the preferred tin source is organic tin (organotin) compounds.

Examples of organic silicon (organosilicon) compounds that may be used include compounds of the formula

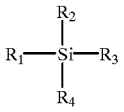

wherein $R_1$, $R_2$, $R_3$, and $R_4$ are selected independently from the group consisting of hydrogen, halogen, hydrocarbyl, and oxyhydrocarbyl and wherein the compound's bonding may be either ionic or covalent. The hydrocarbyl and oxyhydrocarbyl radicals can have from 1–20 carbon atoms which may be substituted with halogen, nitrogen, phosphorus, or sulfur. Exemplary hydrocarbyl radicals are alkyl, alkenyl, cycloalkyl, aryl, and combinations thereof, such as alkylaryl or alkylcycloalkyl. Exemplary oxyhydrocarbyl radicals are alkoxide, phenoxide, carboxylate, ketocarboxylate and diketone (dione).

Suitable organic silicon compounds include trimethylsilane, tetramethylsilane, tetraethylsilane, triethylchlorosilane, phenyltrimethylsilane, tetraphenylsilane, ethyltrimethoxysilane, propyltriethoxysilane, dodecyltrihexoxysilane, vinyltriethyoxysilane, tetramethoxyorthosilicate, tetraethoxyorthosilicate, polydimethylsiloxane, polydiethylsiloxane, polydihexylsiloxane, polycyclohexylsiloxane, polydiphenylsiloxane, polyphenylmethylsiloxane, 3-chloropropyltrimethoxysilane, and 3-aminopropyltriethoxysilane. At present hexamethyldisiloxane is preferred.

Examples of organic tin (organotin) compounds which may be used include tin carboxylates such as stannous formate, stannous acetate, stannous butyrate, stannous octoate, stannous decanoate, stannous oxalate, stannous benzoate, and stannous cyclohexanecarboxylate; tin thiocarboxylates such as stannous thioacetate and stannous dithioacetate; dihydrocarbyltin bis(hydrocarbyl mercaptoalkanoates) such as dibutyltin bis (isoocylmercaptoacetate) and dipropyltin bis(butyl mercaptoacetate); tin thiocarbonates such as stannous O-ethyl dithiocarbonate; tin carbonates such as stannous propyl carbonate; tetrahydrocarbyltin compounds such as tetrabutyltin, tetraoctyltin, tetradodecyltin, and tetraphenyltin; dihydrocarbyltin oxides such as dipropyltin oxide; dibutyltin oxide, dioctyltin oxide, and diphenyltin oxide; dihydrocarbyltin bis(hydrocarbyl mercaptide)s such as dibutyltin bis(dodecyl mercaptide); tin salts of phenolic compounds such as stannous thiophenoxide; tin sulfonates such as stannous benzenesulfonate and stannous-p-toluenesulfonate; tin carbamates such as stannous diethyl carbamate; tin thiocarbamates such as stannous propylthio carbamate and stannous diethyl dithiocarbamate; tin phosphites such as stannous diphenyl phosphite; tin phosphates such as stannous dipropyl phosphate; tin thiophosphates such as stannous O,O-dipropyl thiophosphate, stannous O,O-dipropyl dithiophosphate and stannic O,O-dipropyl dithiophosphate, dihydrocarbyltin bis(O,O-dihydrocarbyl thiophosphate)s such as dibutyltin bis(O,O-dipropyl dithiophosphate); and the like. At present tetrabutyltin is preferred.

To prepare a treated tube of a pyrolytic cracking furnace, its metal surface is contacted with the antifoulant material under conditions suitable for depositing tin or silicon, or both, upon the metal surface of the tube. The metal surfaces of the cracking process system equipment, specifically, the cracking tubes, generally define a reaction zone wherein cracking reactions occur. The antifoulant material is injected into the reaction zone for the purpose of depositing tin and silicon upon the surfaces which define such reaction zone. Thus, temperature and pressure conditions necessary for the cracking of hydrocarbons and for the cracking tubes referred to herein will be those within the reaction zone defined by the cracking process system equipment.

The antifoulant material is contacted with surfaces of the cracking tubes either by pretreating the cracking tubes with the antifoulant material prior to charging the tubes with a hydrocarbon feed or by adding the antifoulant material to the hydrocarbon feed in an amount effective for providing a treated tube having coke formation inhibiting properties.

Any method can be used which suitably treats the tubes of a cracking furnace by contacting such tubes with the antifoulant material under suitable treatment conditions to thereby provide treated tubes. The treated tubes have properties which inhibit the rate of coke formation during the pyrolytic cracking of hydrocarbons within such tubes.

The preferred procedure for pretreating the tubes of the cracking furnace, includes charging to the inlet of the cracking furnace tubes a saturated or slightly superheated steam having a temperature in the range of from about 300° F. to about 500° F. The cracking furnace is fired while charging the tubes with the steam so as to provide a superheated steam which exits the tubes at a temperature exceeding that of the steam introduced into the inlet of the tubes. Generally, the steam effluent will have a temperature upwardly to about 2000° F. Thus, the treating temperature can be in the range of from about 300° F. to about 2000° F., preferably, from about 400° F. to about 1800° F. and, most preferably, from 500° F. to 1600° F. It is desirable for the steam to be charged to the convection section of the cracking furnace therefore first passing through the convection section tubes followed by passing through the radiant section tubes.

The antifoulant material can then be admixed with the steam being charged to the cracker tubes. The antifoulant material can be admixed with the steam as either a neat liquid or as a mixture of the antifoulant material with an inert diluent. It is preferred, however, to first vaporize either the neat liquid or the mixture prior to its introduction into or admixing with the steam. The amount of antifoulant material admixed with the steam can be such as to provide a concentration of the antifoulant material in the steam in the range of from about 1 ppmw to about 10,000 ppmw, preferably, from about 10 ppmw to about 1000 ppmw and, most preferably, from 20 to 200 ppmw.

The admixture of steam and antifoulant material is contacted with or charged to the cracker tubes for a period of time sufficient to provide for treated tubes effective in inhibiting the rate of coke formation during cracking of hydrocarbons. Such time period for pretreating the cracker tubes is influenced by the specific geometry of the cracking furnace including its tubes; but, generally, the pretreating time period can range upwardly to about 12 hours, and longer if required. But, preferably, the period of time for the pretreating can be in the range of from about 0.1 hours to about 12 hours and, most preferably, from 0.5 hours to 10 hours.

In the case where the antifoulant material is directly admixed with the hydrocarbon cracker feed, it can be added in such an amount to be effective in treating the tubes so as to provide for the inhibition of the rate of coke formation during operation. Due to the memory effect resulting from the application of the antifoulant material, the mixing with the hydrocarbon cracker feed is conducted intermittently as required but, preferably, for periods up to about 12 hours. The concentration of the antifoulant material in the hydrocarbon cracker feed during treating of the cracker tubes can be in the range of from about 1 ppmw to about 10,000 ppmw, preferably, from about 10 ppmw to about 1000 ppmw and, most preferably, from 20 to 200 ppmw.

A critical aspect of the invention is the requirement that the hydrocarbon feed be desulfurized prior to it being charged to the treated pyrolytic cracking tube operated under cracking conditions. The critical nature of such prior desulfurization has been addressed elsewhere herein where it is indicated that the sulfur in a non-desulfurized feed interacts with the antifoulant material that is deposited on the treated tube surfaces so as to strip from such surfaces the antifoulant material. The stripping of the deposited antifoulant has the effect of impairing the effectiveness of the antifoulant thereby causing the rate of coke formation to increase. By desulfurizing the hydrocarbon feed prior to charging the treated pyrolytic cracking tubes, the effectiveness of the treated tubes in inhibiting or resisting coke formation is prolonged.

Any suitable method can be used to desulfurize a hydrocarbon feed stream containing a sulfur concentration; provided, the sulfur concentration of such hydrocarbon feed stream is reduced to less than about 50 parts per million moles (ppmm) prior to charging the treated pyrolytic cracking tube. To achieve the greatest benefit from the use of a desulfurized hydrocarbon feed, it is best to minimize the sulfur concentration; since, it has been found that the rate of antifoulant treatment deactivation is dependent upon the concentration level of the sulfur in the hydrocarbon feed. Thus, it is best to charge a desulfurized hydrocarbon feed to the treated pyrolytic cracker tubes having a concentration of sulfur less than about 10 ppmm. Preferably, the concentration of sulfur in the desulfurized hydrocarbon feed is less than about 5 ppmm, most preferably less than 1 ppmm.

A non-desulfurized hydrocarbon feed generally is a hydrocarbon feed having a concentration of sulfur exceeding about 50 ppmm. When referring herein to the sulfur concentration of a hydrocarbon feed, the term "sulfur" means those sulfur compounds that are generally found to be naturally occurring in typical hydrocarbon feedstocks. Most commonly, the sulfur compounds are organic sulfur compounds, but they are not limited to organic sulfur compounds. The sulfur can be removed from the non-desulfurized feed by any known and suitable method. Most common of such methods include hydrodesulfurization, adsorption and absorption processes. The concentration of sulfur in the non-desulfurized hydrocarbon feed that can suitably be removed by such desulfurization processes can range from about 50 ppmm to about 3 mole percent. Preferably, however, the concentration of the sulfur in the non-desulfurized desulfurized feed can range from 100 ppmm to 3 mole percent, most preferably, the sulfur concentration can range from 500 ppmm to 3 mole percent.

The following example is provided to further illustrate the present invention.

EXAMPLE I

This example demonstrates the benefits from desulfurizing a hydrocarbon feedstock prior to charging the resulting desulfurized feedstock to a pyrolytic cracking tube treated with an antifoulant material so as to give a treated tube having coking rate inhibiting properties.

The furnaces used to conduct the cracking experiments of this example were split shell tube furnaces equipped with a 7⅔ feet by ¼ inch outside diamter, Incolloy 800H, 4 pass tube coil. The coil was heated to 1300° F. prior to start up. Nitrogen and steam were introduced into the coil respectively at the rates of 10 standard liters per minute and 225 grams per hour and the operating pressure was adjusted to approximately 20 psia at the coil outlet. After process conditions had stabilized, an antifoulant mixture of 50 ppmw tin as tetrabutyltin and 50 ppmw as hexamethyldisiloxane was introduced (using the nitrogen as an atomizing gas) into the coil and pretreatment timing was begun. After 9 minutes of pretreatment, the nitrogen flow was substituted with ethane and a one minute flow stabilization period began. At the end of one minute, cracking began. The furnace set point temperatures were raised at a rate of 50° F. per minute until a set point temperature of 1850° F. was achieved. Twenty minutes after the start of cracking, the antifoulant was discontinued, and the run was allowed to proceed until a total coil pressure drop of 5 psi was achieved. Total run length (cracking only) was 249 minutes, 15 seconds. For the cracking run using an ethane feedstock with a sulfur concentration, the same procedure as described above was used with the exception that the feed contained a 200 ppmw concentration of dimethylsulfide (DMS) to simulate a sulfur-containing feed.

The two separate cracking runs described above were performed to determine the impact of a sulfur concentration on the performance of a treated tube. The data for these experimental runs are presented in Table 1. The non-desulfurized feedstock had a concentration of dimethylsulfide (DMS) of 200 ppmm. The feed containing DMS simulated an untreated or non-desulfurized feed. The sulfur-free feedstock was essentially free of sulfur. As is shown by the data of Table 1, the coking rate for the treated tube using the sulfur-containing feedstock was more than three times the coking rate for the treated tube using a feedstock having essentially no sulfur concentration. The higher coking rate associated with the cracking of a sulfur-containing feedstock is believed to be caused by sulfur stripping of the antifoulant deposited on the tube surfaces.

TABLE 1

Treated Cracking Tube Coking Rate Data for a Sulfur-Free Feedstock versus a Feedstock having a Concentration of Sulfur

| | Run Description | Run Length (min) | Total Coke (mg) | Coke Rate (mg/hr) |
|---|---|---|---|---|
| 1 | Sulfur-Free Feedstock | 249 | 4753 | 1145 |
| 2 | Feedstock with Sulfur (200 ppmw DMS) | 46 | 2832 | 3694 |

While this invention has been described in terms of the presently preferred embodiment, reasonable variations and modifications are possible by those skilled in the art within the scope of the described invention and the appended claims.

That which is claimed is:

1. A method comprising:

passing a desulfurized hydrocarbon feed through a treated cracking tube, having tin and silicon deposited on the surface exposed to the hydrocarbon feed, operated under cracking conditions.

2. A method as recited in claim 1 wherein said desulfurized hydrocarbon feed has a concentration of sulfur less than about 50 ppmm.

3. A method as recited in claim 2 wherein the rate of coke formation within said treated cracking tube during the cracking of said desulfurized hydrocarbon feed is less than the rate of coke formation within said treated cracking tube during the cracking of a non-desulfurized hydrocarbon feed.

4. A method as recited in claim 2 wherein said non-desulfurized hydrocarbon feed has a concentration of sulfur exceeding about 50 ppmm.

5. A method for prolonging the effectiveness in resisting coke formation of a treated pyrolytic cracking tube utilized in cracking hydrocarbons, said method includes the steps of:

desulfurizing a hydrocarbon feed containing a concentration of sulfur to remove at least a portion of said concentration of sulfur to provide a desulfurized hydrocarbon feed; and passing said desulfurized hydrocarbon feed through said treated pyrolytic cracking tube, having deposited on the surface thereof tin and silicon, operated under cracking conditions.

6. A method as recited in claim 5 wherein the rate of coke formation within said treated pyrolytic cracking tube during the cracking of said desulfurized hydrocarbon feed is less than the rate of coke formation within said treated pyrolytic cracking tube during the cracking of said hydrocarbon feed.

7. A method as recited in claim 6 wherein said concentration of sulfur in said hydrocarbon feed exceeds about 50 ppmm.

8. A method as recited in claim 7 wherein said desulfurized hydrocarbon feed has a concentration of sulfur less than about 50 ppmm.

* * * * *